US005145361A

United States Patent [19]

Kurzinski

[11] Patent Number: 5,145,361

[45] Date of Patent: Sep. 8, 1992

[54] BURNER AND METHOD FOR METALLURGICAL HEATING AND MELTING

[75] Inventor: Edward F. Kurzinski, Pittsburgh, Pa.

[73] Assignee: Combustion Research, Inc., New York, N.Y.

[21] Appl. No.: 677,983

[22] Filed: Dec. 4, 1984

[51] Int. Cl.[5] ..... F27D 7/00; F23M 3/04

[52] U.S. Cl. ..... 432/19; 432/103; 431/2; 431/10; 431/354

[58] Field of Search ..... 431/10.2, 354; 432/19, 432/103, 105, 111

[56] References Cited

U.S. PATENT DOCUMENTS

| | | | |
|---|---|---|---|
| 3,194,650 | 7/1965 | Kurzinski . | |
| 3,404,199 | 10/1968 | Hoffmann | 432/111 |
| 3,441,634 | 4/1969 | Iken et al. | 432/111 |
| 3,488,700 | 1/1970 | Iken et al. | 432/111 |
| 3,888,621 | 6/1975 | Williams | 432/103 |
| 4,017,253 | 4/1977 | Wielang et al. | 431/10 |
| 4,130,388 | 12/1978 | Flanagan | 431/10 |
| 4,189,914 | 2/1980 | Marek et al. | 431/2 |
| 4,329,932 | 5/1982 | Takahashi et al. | 431/10 |
| 4,517,020 | 5/1985 | Steinbiss et al. | 432/105 |

*Primary Examiner*—Henry C. Yuen

*Attorney, Agent, or Firm*—Dennis H. Lambert

[57] ABSTRACT

An object of this invention is to reduce the amount of substantially pure oxygen required during heating, refining and melting operations in metallurgical processes.

In accordance with the invention, a burner (10) is provided in which air is aspirated and mixed with fuel and substantially pure oxygen. Additionally, swirl vanes (26) are provided to impart a swirling motion to the gasses in the burner, producing a flame which is distributed over a greater volume of the charge to be heated in the furnace. The aspirated air contains nitrogen which is heated by the combustion flame and is dissipated through the charge to assist in the melt down of the charge. Oxygen is introduced into the burner through a nozzle (22), which extends into the throat of the burner tube (12), forming a venturi (20,21) to aspirate the air into the burner.

16 Claims, 2 Drawing Sheets

FIG. 1
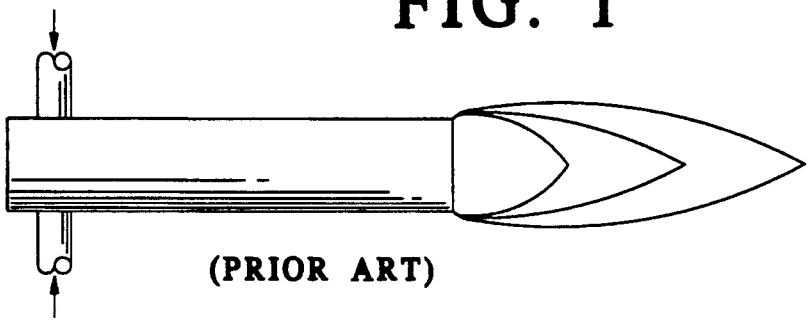
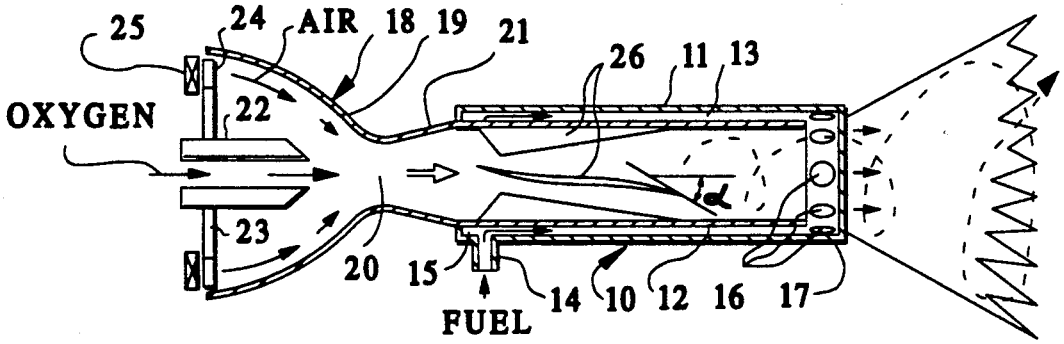
FIG. 2
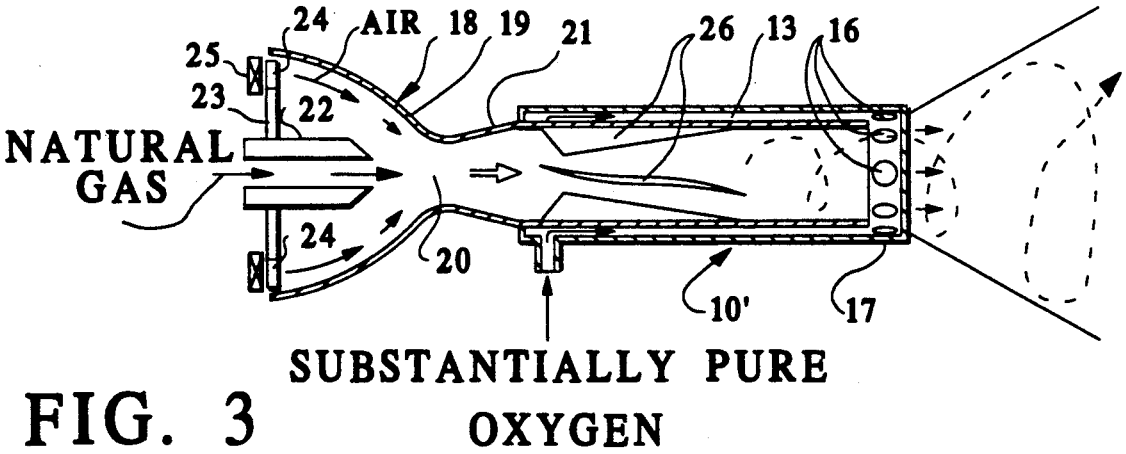
FIG. 3

BURNER AND METHOD FOR METALLURGICAL HEATING AND MELTING

DESCRIPTION

1. Technical Field

This invention relates to improvements in the heating, melting and refining operations of metal and other producing processes. More particularly, the invention relates to novel method and apparatus in which oxygen and fuel are supplied to a burner and combusted in a furnace to change the furnace material or charge from a solid to a preheated or molten state.

2. Background Art

In conventional heating and melting operations, electric power or several different types of fuels, i.e., natural gas, propane, coal gas, oil, etc., can be used to obtain the high temperatures necessary to change the furnace charge from a solid to a preheated or molten state. In addition to the energy sources noted above, substantially pure oxygen, generally 99.5% oxygen, is mixed with the fuel gas to produce extremely high flame temperatures to effect or supplement rapid heating or melting of the furnace charge, particularly in iron and steel making.

Conventional oxygen and fuel gas burners used in such melting processes have found particularly widespread usage in metallurgical plants as a method to reduce the melting time, and hence the total energy consumed, necessary to bring the charge to a molten state. These burners, often referred to as oxy-fuel burners, utilize various mixtures of substantially pure oxygen and fuel to produce the characteristic high temperature melting flame. However, the high cost of substantially pure oxygen renders the operation of such burners relatively expensive.

Moreover, conventional oxy-fuel burner designs typically produce an elongate, centrally concentrated flame which tends to penetrate the furnace charge, resulting in an inefficient melt of the charge. In other words, the concentrated flame tends to melt a hole of smaller cross-sectional area into the furnace charge.

DISCLOSURE OF THE INVENTION

The present invention is applicable to a wide variety of furnaces used to heat, refine or melt and to a wide variety of charge materials, including ferrous and non-ferrous metals, glass, cement, etc. These processes, for maximum effectiveness and most efficient use of fuels, depend upon proper placement and design of burners. For example, in electric arc furnace steelmaking, oxy-fuel burners are directed to fire into the colder parts of the furnace where the radiation energy from the electric arc is markedly reduced. Also, burner heating efficiency is influenced by the flame temperature and the "scrubbing" velocity and volume of the combustion products resulting from the burner flame.

Accordingly, the present invention provides novel methods and apparatus to increase the heat transfer rates to the cold charge by increasing the "scrubbing" velocity and volume of the flame and combustion products.

In accordance with the present invention, it has been discovered that by incorporating a venturi and swirl chamber, and by utilizing the pressure of either or both the fuel and oxygen supplied to the burner to aspirate ambient air into the burner, several metallurgical and operational advantages result.

For instance, contrary to conventional expectations, it has been found that the nitrogen ($N_2$) contained within the aspirated air is heated by the combustion flame to such a high temperature that it too can be utilized to assist in the meltdown of the furnace charge. Heretofore, it has been thought that the presence of nitrogen (detrimental to the burner flame temperature by causing a severe temperature drop when mixing with the combustion products) would substantially decrease heat transfer to the furnace charge. Instead, in the method of the invention the relatively large volume of nitrogen contained in the aspirated air is heated by the combustion flame and then is dispersed through the furnace charge at a sufficiently high temperature that it actually assists in the melting of the charge. In addition, this heated nitrogen, not present in the combustion products of a conventional oxy-fuel burner, passes over at high velocity or "scrubs" the charge material, thereby further increasing heat transfer to the charge. It is well known that the rate of heat transfer to a surface receiving heat is increased in direct proportion to the velocity of the gasses passing over the surface.

Additionally, and perhaps most significantly, the oxygen contained in the aspirated air takes the place of otherwise required commercially obtained substantially pure oxygen, reducing by up to fifty percent (50%) the total feed of substantially pure oxygen necessary to effect a sufficiently high flame temperature for charge melting over any conventionally designed oxy-fuel burner system.

Further, the burner of the invention produces a flame which is less concentrated and thus dissipates heat throughout the furnace charge much more effectively than any conventional burner design. The high velocity mixing and broader flame produced by the burner of the invention are caused by the arrangement of burner housing, venturi and swirl vanes, which result in a swirling gas stream upon exit from the burner nozzle. This results in a high velocity swirling flame which dissipates heat throughout the furnace charge more rapidly than any conventional burner system. All conventionally designed oxy-fuel burner systems produce a characteristic inner cone/gas feather/outer cone flame that concentrates the heat of combustion in a very small area. This flame pattern is excessively wasteful of fuel gas and oxygen, and inefficiently transfers heat into the furnace charge.

BRIEF DESCRIPTION OF THE DRAWINGS

These and other objects and advantages of the invention will become apparent from the following detailed description and accompanying drawings, in which like reference characters designate like parts throughout the several views, and in which:

FIG. 1 is a schematic view of a conventional, prior art burner;

FIG. 2 is a longitudinal sectional view of a first form of burner according to the invention;

FIG. 3 is a view similar to FIG. 2 of a second form of burner according to the invention;

BEST MODE FOR CARRYING OUT THE INVENTION

Figure 6:
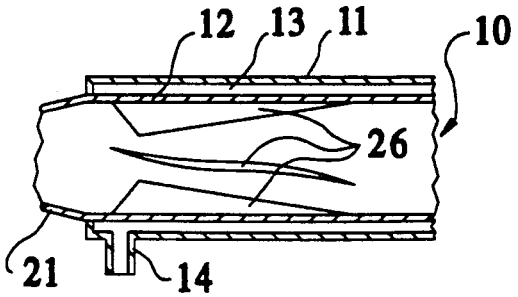
FIG. 6 is an enlarged longitudinal sectional view of a portion of the burner of FIG. 2.

Referring more specifically to the drawings, a preferred form of the invention is depicted at 10 in FIGS. 2 and 6 and comprises an elongate outer tube 11 with a radially spaced, elongate inner tube 12 concentric therewith and defining an elongate annular space 13 therebetween. A fuel (natural gas, propane, etc.) inlet 14 is connected with one end 15 of the annular space 13. A plurality of fuel outlets 16 from the annular space 13 are formed in the inner tube 12 at the other end 17 thereof for supplying fuel to the burner outlet to mix with the air and substantially pure oxygen stream flowing through inner tube 12. In another form of the burner, the fuel flows directly from the annular space 13, within the Q/A velocity range limits desired for proper operation, and mixes with the air and substantially pure oxygen stream flowing through inner tube 12.

A diametrically enlarged aspirating and mixing chamber 18 is connected with the inlet end of tube 12 for supplying air and substantially pure oxygen thereto and is defined by a wall 19 providing a gradually reduced transition until forming a properly sized throat section 20, after which a gradually tapered expansion section 21 connects to the inlet end of tube 12. A nozzle 22 extends from the end 23 of chamber 18 to adjacent the throat section 20 or inlet end of the inner tube 12 for supply of substantially pure oxygen under pressure from a suitable source, not shown. The nozzle 22 is spaced at a distance from throat section 20 and discharges axially into the throat section to attain optimum aspiration of air through a plurality of openings 24 formed through the end 23 of chamber 18. Movable shutters 25 provide control of the quantity of aspirated air by covering openings 24 to the degree required for furnace operation. A venturi section is formed by wall 19, throat section 20 and expansion section 21.

Control of the flow and pressure of the fuel, oxygen and air is achieved in any suitable, conventional way, as by use of valves and regulators, for example, not shown. If desired, control systems such as employed in the patents of record could be used in the present invention, and such disclosures are incorporated herein by reference. However, since neither the particular controls nor any specific ratio of oxygen to fuel are considered novel or essential to the invention as claimed herein, no detailed description is offered or believed necessary for an understanding of the claimed invention.

A plurality of swirl vanes 26 are provided on the inner surface of the inner tube 12 near the inlet end thereof for imparting a swirling motion to the aspirated air and substantially pure oxygen flowing therethrough. As seen best in FIG. 6, the swirl vanes 26 on the inner tube 12 are disposed at an angle $\alpha$ to the axis of the burner, and the leading edges are tapered for smoother flow. Further, to produce the desired results, the vanes should have a length in the range of from about two to three times the inside diameter of the inner tube 12, and the angle $\alpha$ should be in the range of from about 20° to about 40°. Also, there preferably should be no more than about five vanes, spaced equidistantly around the inner surface of the inner tube.

In operation, oxygen under pressure (typically about 70 psi) is introduced through the nozzle 22, and fuel under pressure is introduced through the fuel inlet 14. The fuel is generally supplied at about 25 psi. The oxygen, flowing into the inlet end of the inner tube 12 through the venturi throat 20 and gradually tapered expansion section 21 causes a drop in pressure in the chamber 18, aspirating atmospheric air into the chamber through the shuttered openings 24. A high velocity rotation is imparted to the gasses by the vanes 26, creating a vortex. Further, the swirling gasses are accelerated along the surface of the inner tube, i.e. along the periphery of the swirl chamber, concentrating the gasses at the periphery of the swirl chamber and decreasing the concentration of gasses at the center of the swirl chamber. This results in a more turbulent flow for mixing with the fuel gas entering the stream at the outlet end of the burner via the openings 16. The flame core produced by the burner of the invention thus contains at least twenty percent (20%) less non-combusted fuel gas than do prior art devices.

The oxygen contained in the aspirated air takes the place of substantially pure oxygen which would otherwise have to be supplied through the nozzle 22 from a commercial source, reducing the need for commercially supplied oxygen by up to fifty percent.

Further, the nitrogen in the aspirated air is heated up to as much as 4,500° F. by the combustion flame and is then dispersed through the furnace charge, assisting in the meltdown of the furnace charge.

In comparative tests conducted between the invention and a prior art system, a nominal thirty-five ton electric arc furnace for producing steel for concrete reinforcing bar was operated, first using a conventional burner and then using the burner of the invention.

The furnace hearth diameter was twelve feet, six inches, and the electric power to the furnace was 13,000 KVA.

Electrical control of oxygen and natural gas facilitated burner operation. Three push buttons, located on a pendant control panel activated solenoids in the oxygen and natural gas supply conduits to permit: (1) opening of the solenoids to start low and controlled flows of oxygen and natural gas for flame ignition at a "low-fire" condition; (2)closing "low-fire" solenoids and opening solenoids to start high and controlled flows of oxygen and natural gas to start the "high-fire" melting flame; and (3) shut off both oxygen and natural gas flows.

A first cold charge of 21,270 pounds of scrap steel was placed in the furnace and immediately thereafter a conventional oxygen-fuel burner was positioned in the furnace charging door and ignited. The burner was a conventional concentric tube design, wherein oxygen was passed through a center tube having an outside diameter of 1-¾ inches and a wall thickness of ⅛ inch. The oxygen tube was surrounded by an outer steel tube having a 2-¾ inch outside diameter and a ⅛ inch thick wall. Natural gas was introduced into the annular space between the inner and outer tubes. Oxygen flow was set at 19,600 SCFH (standard cubic feet per hour) and natural gas flow was set at 9,800 SCFH. The burner flame was directed into the furnace interior and onto the scrap steel to maximize melting effectiveness and utilization of fuel and oxygen. Heating was continued for 40 minutes, after which the burner was shut off and a second charge of 24,380 pounds of scrap steel charged into the furnace. Immediately following introduction of the second charge, the burner was reignited and the second charge was melted down in 46 minutes. A third charge of 28,550 pounds of scrap steel was then added and melted down in 42 minutes. Total firing time was 128 minutes.

After the molten steel was tapped from the furnace, the test was again conducted, using the same furnace, but instead of the conventional burner, a concentric tube oxygen-air-fuel burner in accordance with the invention was positioned to direct a flame into the furnace and onto the charge. The outside diameter of the inside tube 12 was 3.25 inches, with a wall thickness of 0.156 inches. The outside diameter of the outer tube 11 was 4.25 inches with a wall thickness of 0.156 inches. Nozzle 22 had a 9/16 inch diameter orifice, and shutter 25 was placed in the closed position. A first charge of 26,030 pounds of steel scrap was charged into the furnace, and immediately thereafter the push button was activated to start the ignition cycle on the oxy-air-natural gas burner of the invention. A flow rate of 8,000 SCFH of substantially pure oxygen was established through the nozzle 22, and a flow rate of 4,500 SCFH of natural gas was set through inlet 14. The flame was ignited, the "high-fire" pushbutton activated and shutter 25 opened. The oxygen pressure was increased to 72 psig at nozzle 22 and the flow rate of substantially pure oxygen was increased to 19,600 SCFH. The flow of 19,600 SCFH of substantially pure oxygen aspirated 19,600 SCFH of ambient air, or 3,920 SCFH of aspirated oxygen and 15,680 SCFH of aspirated nitrogen. To maintain a stoichiometric oxygen-to-natural gas ratio of 2.0 to 1.0, the natural gas flow was increased to 11,760 SCFH. The first charge of 26,030 pounds of scrap steel was melted in 31 minutes. A second charge of 25,700 pounds of scrap steel was added and melted in 26 minutes. A third charge of 28,370 pounds of scrap steel melted in 32 minutes. Total firing time was 89 minutes.

The "power-on to tap-time" for the conventional burner was 2 hours, 45 minutes, whereas the "power-on to tap-time" for the invention was 2 hours, 15 minutes.

Other steel heats were made to compare performance of a conventional oxy-fuel burner fired at 18,710 SCFH of substantially pure oxygen and 9,355 SCFH of natural gas with the burner of the invention operated so that 17,125 SCFH of substantially pure oxygen at a pressure of 64 psig at the orifice of the nozzle 22 aspirated 7,925 SCFH of ambient air (equivalent to 1,585 SCFH of aspirated oxygen and 6,340 SCFH of nitrogen). The burner of the invention decreased the scrap melting time by an average of 5 minutes when compared to the conventional oxy-fuel burner, both being operated at the same firing rate of 9,355,000 BTU/HR. Visual observation showed that the burner of this invention melted a greater volume of scrap because of the higher velocity of the combustion products, incorporating the aspirated, heated nitrogen.

Comparable tests were conducted over a period of one week. Two methods of using the burner of this invention were apparent. In the first method, the burner of the invention could be used to substantially increase the firing rate and heatoutput, by increasing the natural gas flow to match the quantity of oxygen contained in the aspirated air. When operated in this manner, the resulting reduction in melting time enabled production of approximately 1.5 completed steel heats for each heat completed using conventional burner design. In the second method, the amount of substantially pure oxygen supplied to the burner of the invention could be reduced by the amount of the aspirated oxygen and an improvement in the meltdown time still achieved because of the heated aspirated nitrogen, compared with conventional oxy-fuel burners operated at the same firing rate. With either method, a substantial improvement in operation is achieved, with substantially less commercially obtained substantially pure oxygen being required to produce a given quantity of molten steel.

Another significant advantage of the burner of the invention is the added feature that the lower flame temperature proves to be less harsh on the furnace refractories, when compared to conventional oxy-fuel burners. This results in reduced refractory damage and lower costs.

The performance and operating results shown by the burner of the invention are clearly superior to conventional designs.

A second form of the invention is shown at 10' in FIG. 3. In this form, the high pressure natural gas introduced through the nozzle aspirates ambient air into the inner tube 12. Substantially pure oxygen is introduced into the annular space between the inner and outer tubes. In all other respects, this form of the invention is identical to the first form described herein.

Figure 4:
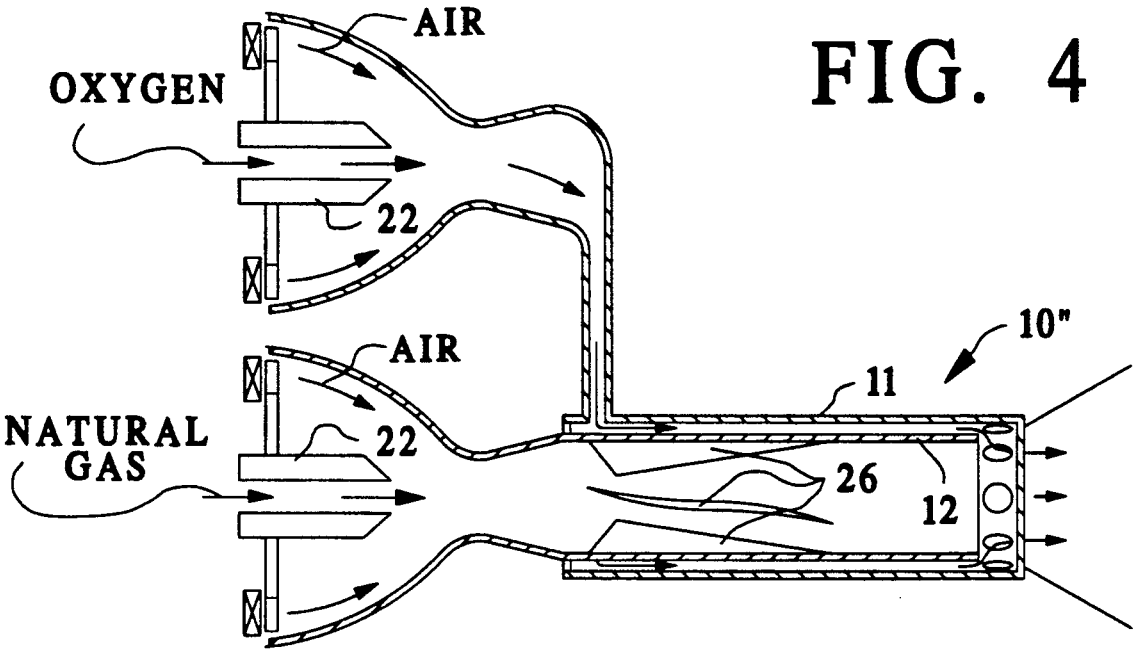
FIG. 4 is a view similar TO FIGS. 2 and 3 of a third form of the burner of the invention.
Figure 5:
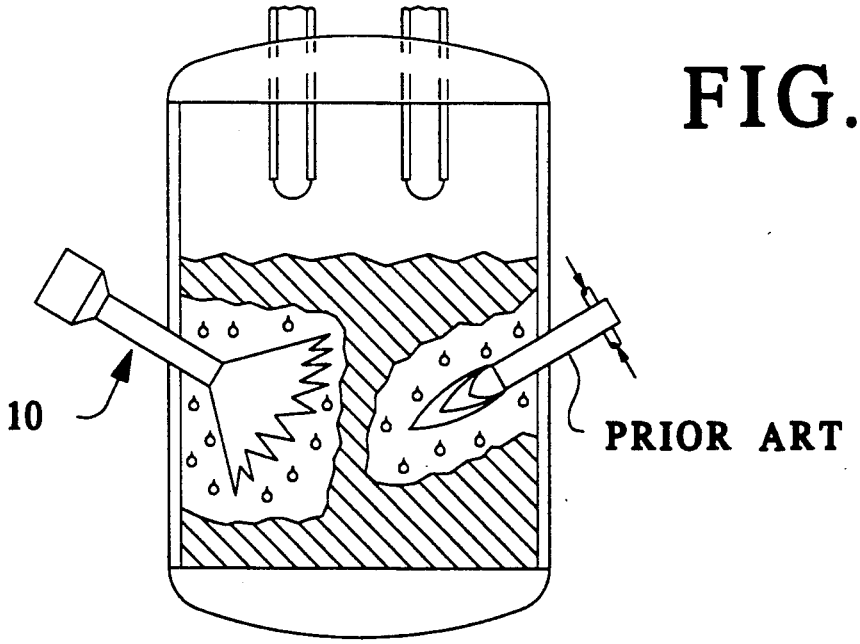
FIG. 5 is a schematic view depicting a typical furnace with a burner according to the invention shown on the left side and a conventional prior art burner shown on the right side.

A third form of the invention is shown at 10'' in FIG. 4, wherein both the substantially pure oxygen and natural gas are introduced through nozzles at high pressure. In this form of the invention, ambient air is aspirated into the burner by the flow of both the oxygen and natural gas, resulting in an oxygen-air-natural gas mixture containing between 40% and 95% oxygen, with the oxygen to natural gas ratio varying between 1.3:1.0 to 2.2:1.0 by volume.

It is to be understood, however, that the several embodiments of the invention shown and described herein are by no means all of the embodiments possible for this invention. For example, the burner of FIG. 2 is equally as effective if the fuel is introduced through the inner tube and the substantially pure oxygen-aspirated air is introduced into the annular space between the inner and outer tubes. In FIG. 3, the substantially pure oxygen can be introduced into the inner tube and the natural gas-aspirated air can be introduced into the annular space between the inner and outer tubes. Also, in FIG. 4, the substantially pure oxygen-aspirated air can be introduced into the inner tube and the natural gas-aspirated air can be introduced into the annular space between the inner and outer tubes. A major design consideration in all of the embodiments must be followed, ie. the Q/A velocities must be within the ranges specified hereinafter for the oxygen and fuel streams.

The burner device has several features to permit safe operation with substantially pure oxygen, fuel and mixtures thereof with atmospheric air. Also, operation with substantially pure oxygen-aspirated air mixtures is inherently safer when compared to use of substantially pure oxygen alone. Further safety measures are incorporated in the burner, including the use of non-ferrous metals, such as bronze or monel, in one or more locations, such as the oxygen nozzles, the venturi and the inner tube, to preclude the possibility of spark ignition resulting from particulate impingement on the conduit surfaces when the fluids are flowing during burner operation. Also, screening devices are located in the openings where the atmospheric air is aspirated into the burner.

It should be noted that with the invention, from about 40% to about 95% oxygen by volume can be used in the oxygen/fuel mixture, as compared with commercially available substantially pure oxygen, about 99.5%, in a conventional system. That is, with the invention, nitrogen can also be present with the oxygen and fuel mixture, whereas in a conventional system substantially pure oxygen is supplied with the fuel.

Further, the nitrogen in the atmospheric air aspirated into the burner of the invention is heated, enhancing the heat transfer efficiency.

Best results are obtained, when natural gas is the fuel, by maintaining the oxygen/fuel ratio in the range of from about 1.3:1.0 up to about 2.2:1.0, by volume; and, when propane is the fuel, by maintaining the oxygen/fuel ratio in the range of from about 3.7:1.0 up to about 4.6:1.0. Further, when natural gas is the aspirating medium, the oxygen content in the air/natural gas ratio should be maintained below about 1.1:1.0, by volume, prior to the addition of substantially pure oxygen, and then raised to between 1.6:1.0 and 2.1:1.0, by volume, after the addition of substantially pure oxygen; and, when propane is the aspirating medium, oxygen content in the air/propane ratio should be below about 3.5:1.0 prior to the addition of substantially pure oxygen and between 4.2:1.0 and 4.7:1.0, by volume, after the addition of substantially pure oxygen.

Further, satisfactory results are obtained when the Q/A velocity of the oxygen-air mixture varies between 75 and 450 fps, and the Q/A velocity of the gaseous fuel varies between 75 and 300 fps, prior to mixture of the gaseous fuel with the oxygen-air mixture. As used herein, the Q/A velocity is defined as the quantity of gas (oxygen, air and gaseous fuel, for example) in cubic feet per second, divided by the cross-sectional area of the conduit.

Further, although adjustable shutters have been described and shown as a means of controlling the aspiration of atmospheric air into the burner, specifically sized openings could be used to control the flow of atmospheric air into the burner. In such case, the openings would have a predetermined size to control flow in accordance with desired results, i.e. to maintain a 40% to 95% oxygen content, by volume, in the substantially pure oxygen and air admixture prior to admixture with the fuel gas.

In one metallurgical process according to the invention, wherein the fuel is liquid petroleum, such as kerosene, about 275 cubic feet of oxygen are combusted with each gallon of fuel.

I claim:

1. In a process for heating and treating charged materials in a furnace, wherein fuel and substantially pure oxygen are introduced under pressure, mixed and combusted in a burner to produce a flame, and the flame is directed onto the charged material to heat and treat it, the improvement comprising the steps of:

using at least one of the fuel and substantially pure oxygen to aspirate a gas containing oxygen and nitrogen into the burner, and mixing the gas with the fuel and substantially pure oxygen prior to combustion, wherein the oxygen in the aspirated gas replaces a quantity of substantially pure oxygen that would otherwise have to be commercially obtained;

heating the aspirated nitrogen to an elevated temperature by contacting it with said flame;

imparting a swirling motion to the mixture of fuel, aspirated gas and substantially pure oxygen in a swirl chamber in the burner to obtain a short, swirling, bushy flame having a high velocity; and directing the flame and heated nitrogen into the charged material to heat and treat it by convection heating, said heated nitrogen facilitating heating of the charged material in a reduced amount of time, and said swirling, bushy, high velocity flame and heated nitrogen contacting the charged material over a broad area and at high velocity, enhancing the rate of heating of the material due at least in part to the scrubbing action of the flame and heated nitrogen on the material.

2. A process as claimed in claim 1, including the steps of:

causing at least one of the fuel, aspirated gas and substantially pure oxygen to flow through an inner tube of a pair of concentric tubes; and causing at least one of said fuel, aspirated gas and substantially pure oxygen to flow through the annular space between the inner and outer tubes of said concentric tubes, said flows mixing at a discharge end of said burner before exiting said burner and being ignited.

3. A processes as claimed in 1, wherein:

the oxygen-containing gas is ambient air aspirated into the burner by one of the fuel and substantially pure oxygen prior to the admixture thereof.

4. A processes as claimed in 3, wherein:

the ambient air is aspirated into the burner by the flow of substantially pure oxygen and is conducted in a substantially confined path until subsequent admixture with the fuel.

5. A processes as claimed in 3, wherein:

the ambient air is aspirated into the burner by the flow of fuel into the burner and is conducted in a substantially confined path until subsequent admixture with the substantially pure oxygen.

6. A processes as in claimed in 3, wherein:

the oxygen/fuel ratio, when natural gas is the fuel, is in the range of from about 1.3:1.9 up to about 2.2:1.0, by volume.

7. A processes as in claim 3, wherein:

the oxygen/fuel ratio, when propane is the fuel, is in the range of from about 3.7:1.0 up to about 4.7:1.0, by volume.

8. A processes as claimed in 4, wherein:

the fuel is a liquid petroleum fuel, such as kerosene, and about 275 cubic feet of oxygen are combusted with each gallon of fuel.

9. A processes as claimed in 5, wherein:

natural gas is the fuel, and the oxygen/natural gas ratio in the air-natural gas mixture is below about 1.1:1.0, by volume, and is conducted through a conduit prior to the subsequent addition of substantially pure oxygen; and substantially pure oxygen is added to raise the oxygen/natural gas ratio in the air-natural gas-substantially pure oxygen mixture to between about 1.3:1.0 and 2.2:1.0.

10. A processes as claimed in 5, wherein:

propane is the fuel, and the oxygen/propane ratio is below 3.2:1.0, by volume, in the air-propane mixture prior to the addition of substantially pure oxygen; and substantially pure oxygen is added to raise the oxygen/propane ratio in the air-propane-substantially pure oxygen mixture to between about 4.2:1.0 and 4.7:1.0, by volume.

11. A processes as claimed in 3, wherein:

the Q/A velocity, "Q" being the quantity of oxygen and air in standard cubic feet per second and "A" being the cross-sectional area of the conduit in square feet, of at least one of the substantially pure oxygen and air mixture and the substantially pure oxygen alone, varies between 75 and 450 feet per second; and the Q/A velocity of at least one of the gaseous fuel alone and the gaseous fuel and air mixture, varies between 75 and 300 feet per second, prior to admixture of the fuel-containing flow stream with the oxygen-containing flow stream.

12. A processes as claimed in 4, wherein:

the ambient air is at an elevated temperature prior to aspiration into the burner.

13. A processes as claimed in 3, wherein:

the charged material is one of scrap steel, refractory, glass or cement composition.

14. A process as claimed in claim 2, including the steps of:

causing substantially pure oxygen to flow under pressure through a nozzle and into the throat of a first venturi, aspirating said oxygen-containing gas into the venturi and forming a mixture with the gas;

directing said gas and substantially pure oxygen mixture to flow into and through the annular space between the concentric tubes; and causing fuel under pressure to flow under pressure through a nozzle and into the throat of a second venturi, aspirating oxygen-containing gas into the venturi and forming a mixture with the gas, directing said fuel and gas mixture to flow into and through the inner tube of said concentric tubes for admixture with the mixture flowing through the annular space.

15. A process as claimed in claim 14, including the step of:

imparting said swirling motion to the mixture flowing through the inner tube, accelerating the mixture and concentrating it at the wall of the inner tube.

16. A process as claimed in claim 1, wherein:

the velocity of the substantially pure oxygen and aspirated air mixture ranges from about 75 feel per second up to about 450 feet per second, and the velocity of the fuel ranges from about 75 feet per second up to about 300 feet per second.

* * * * *